US005535129A

United States Patent [19]

Keijser

[11] Patent Number: 5,535,129

[45] Date of Patent: Jul. 9, 1996

[54] FLATNESS CONTROL IN THE ROLLING OF STRIP

[75] Inventor: Olof Keijser, Västerås, Sweden

[73] Assignee: Asea Brown Boveri AB, Vasteras, Sweden

[21] Appl. No.: 343,506

[22] PCT Filed: Jun. 7, 1993

[86] PCT No.: PCT/SE93/00501

§ 371 Date: Nov. 29, 1994

§ 102(e) Date: Nov. 29, 1994

[87] PCT Pub. No.: WO94/00255

PCT Pub. Date: Jan. 6, 1994

[30] Foreign Application Priority Data

Jun. 22, 1993 [SE] Sweden ..... 9201911

[51] Int. Cl.[6] ..... B21B 37/00

[52] U.S. Cl. ..... 364/472; 364/469

[58] Field of Search ..... 364/469–473, 364/563; 72/8, 11, 12, 16, 17, 34; 73/862.07, 159

[56] References Cited

U.S. PATENT DOCUMENTS

| | | | |
|---|---|---|---|
| 3,936,665 | 2/1976 | Donoghue | 364/469 |
| 4,537,050 | 8/1985 | Bryant et al. | 72/8 |
| 4,576,027 | 3/1986 | Yoshida et al. | 364/472 |
| 4,587,819 | 5/1986 | Hausen | 72/9 |
| 5,267,170 | 11/1993 | Anbe | 364/472 |

*Primary Examiner*—Paul P. Gordon
*Assistant Examiner*—Steven R. Garland
*Attorney, Agent, or Firm*—Watson Cole Stevens Davis

[57] ABSTRACT

The invention relates to an optimization of the control actions "c" via control members for the work rolls during flatness control of strip and comprises a method for evaluation of the control actions and an evaluation device which constitutes an integral part of the control equipment. The control actions are obtained by solution of the relationship $c=(A^TA)^{-1}\cdot A^T\cdot f=B\cdot f$, wherein A is a matrix which describes the stress distribution which arises across the strip when the different control members are activated and wherein "f" is a vector which contains the flatness errors obtained after measurement.

5 Claims, 1 Drawing Sheet

$$f_1^* = c_S \cdot \varphi_S + c_B \cdot \varphi_B + c_F \cdot \varphi_F$$

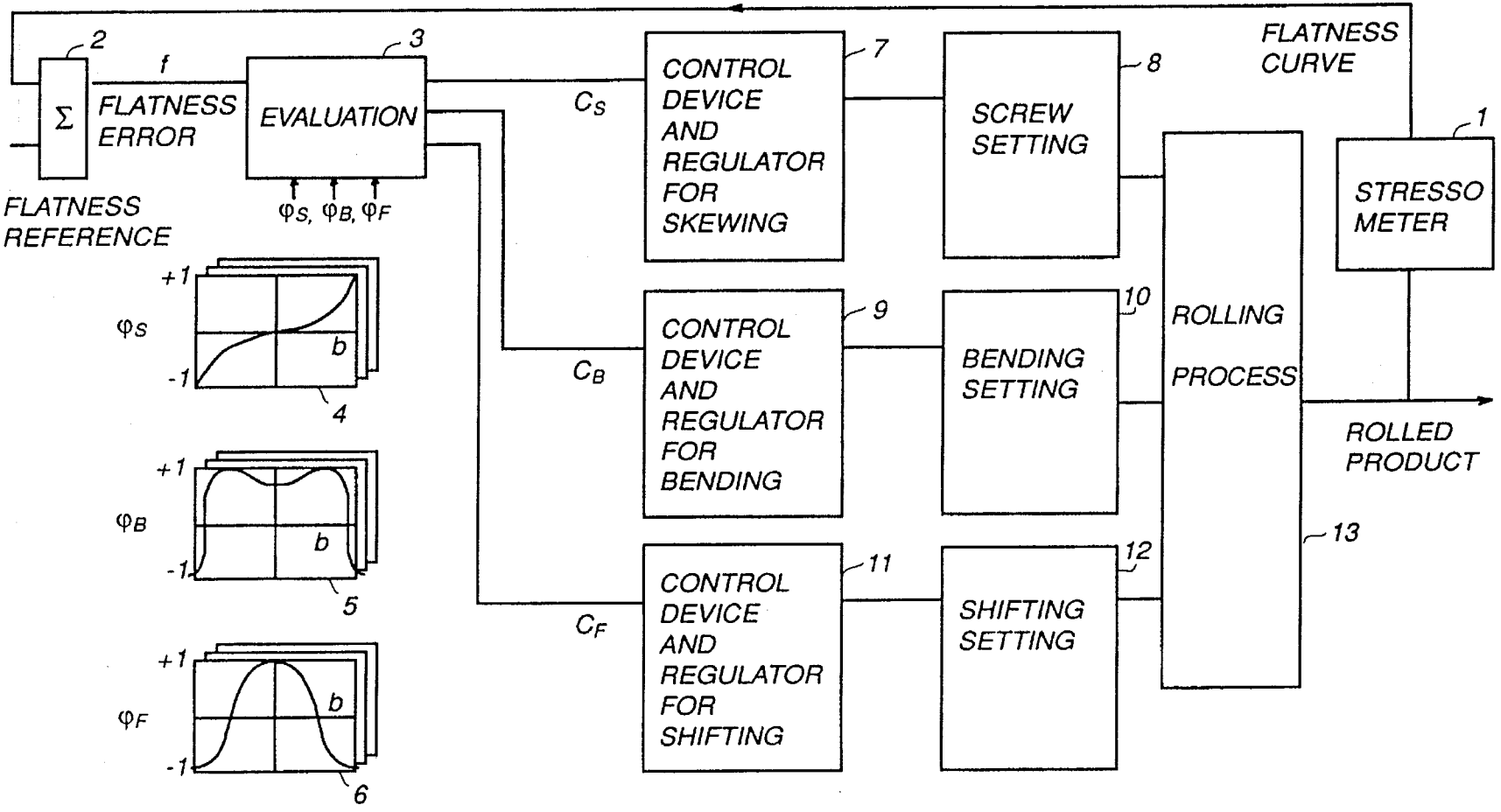
$$f_1^* = c_S \cdot \varphi_S + c_B \cdot \varphi_B + c_F \cdot \varphi_F$$

FLATNESS CONTROL IN THE ROLLING OF STRIP

TECHNICAL FIELD

The flatness of a rolled product is determined, inter alia, by the work rolls of the rolling mill, and the flatness can thereby be influenced by the setting of the different control members of the rolls which may comprise screws, bending cylinders, shifting devices, etc. The present invention relates to a method and a device for evaluation of the input signals to the control devices of the control members which are needed to influence the flatness such that the desired accuracy with regard to flatness is attained.

BACKGROUND ART, THE PROBLEMS

The control members which are included in a rolling mill influence the flatness of the strip in different ways. The screws of the rolling mill are used for setting the roll gap across the strip or for adjustment or intentional angular adjustment of the roll gap. Normally bending cylinders are provided, both for bending of the work rolls and for bending of intermediate rolls in a 6-high rolling mill. Normally, also so-called shifting devices are included for axial shifting of the rolls.

A condition for achieving the desired flatness of the rolled product is to have a more or less continuous access to a measure of actual flatness across the strip, that is, a flatness curve. With a known flatness curve, the rolling mill can be provided with a closed-loop flatness control. In a classical manner, the flatness curve obtained is compared with the desired flatness. The flatness errors which thereby arise are then used, in accordance with different models, for influencing the control members to minimize the flatness errors. Thus, the flatness control comprises several executing devices, which means a relatively extensive evaluation process to decide on the magnitude of the various actions by the control members which provide the best result.

A very suitable measurement device—which is often used in these applications—for determining the flatness curve of the rolled strip is the "STRESSOMETER", developed by Asea Brown Boveri AB, which has been available on the market since the middle of the 60's and which has been described in a large number of pamphlets and other publications. The measurement device is designed as a measuring roll, with approximately 50 measuring points across the strip, which in most cases can be placed between the mill stand and the wind-up reel without the use of deflector rolls. The measurement takes place with the aid of force transducers, based on the magnetoelastic principle, and primarily provides the stress distribution of the strip along the measuring roll. If the stress is greater than the buckling stress for the material, the sheet buckles when the strip is left free with no influence by any tensile force. The stress distribution is a flatness curve for the strip across the rolling direction. A more detailed description of the measurement principle is given, inter alia, in an article in IRON AND STEEL ENGINEER, April, 1991, pp. 34–37, "Modern approach to flatness measurement and control in cold mill" by A. G. Carlstedt and O. Keijser. The article discloses that, because of the relatively extensive signal processing which is required to obtain the flatness curve, this will be updated at intervals of about 50 ms.

When rolling strip, it is important to check and to have the correct roll gap since small variations along the work rolls give a varying reduction of the thickness across the strip, which in turn leads to an inferior flatness curve. The task of the flatness control is thus to maintain an existing curve constant during the whole rolling operation.

As is clear, among other things from the above-mentioned article in IRON AND STEEL ENGINEER, a technique is often used which comprises modifying, with the aid of the bending cylinders, the shape of the work rolls to influence the flatness of the strip. As will have been clear, however, there are several other control possibilities which can be used to influence the flatness curve. A concept for flatness control, in which several control members can be activated, is also described in the article mentioned. The concept includes a model comprising an evaluation strategy for which control members are to be activated as well as processing of collected measured data to obtain, by means of the least squares method, control signals to the control devices and the regulators for the different control members. In the example shown, the flatness control comprises skewing, axial shifting, and bending of the work rolls but in the general case it may comprise additional control possibilities.

In principle, the least squares method entails a possibility, each time the flatness error is updated, that is, after each comparison between the actual flatness curve and the desired flatness curve, of obtaining the combination and extent of actions by the control devices which are needed for the flatness error to be as small as possible. However, this method presupposes that the stress distribution, which arises across the strip when the different control members are activated, is known. The stress distribution can either be calculated or measured with the aid of the measuring roll. Assuming, as in the example shown, that there are three control members, for example skewing with a stress distribution $\phi_s$, bending with a stress distribution $\phi_B$, and axial shifting with a stress distribution $\phi_F$, it is possible, using the least squares method, to indicate for each updated flatness error the actions by the different control members determined by $$f^*_1 = c_S \cdot \phi_S + c_B \cdot \phi_B + c_F \cdot \phi_F \quad (1)$$

where $c_S$, $c_B$ and $c_F$ are the input signals to the control devices and regulators of the control members, which signals are converted into roll gaps. It is obvious that these calculations require very large computer capacity.

The approximation problem in general form comprises finding, with the aid of a number of measured data $f(x_i)$ with $i=1, 2, \ldots m$, a simple function $f^*$ by means of the least squares method which approximates $f(x_i)$ as good as possible. The further description of the least squares method is based on the designations used in Lärobok i Numeriska Metoder ("Textbook of Numerical Methods") by P Pohl, G Eriksson and G Dahlquist, published by Liber tryck, Stockholm. It is assumed here that the simple function $f^*$ is to be a linear combination of pre-selected functions $\phi_1, \ldots \phi_n$ according to $$f^*_n = c_{1\phi 1} + c_{2\phi 2} + \ldots + c_{n\phi n} \quad (2)$$

and the task of the least squares method is then to determine $c_1, c_2 \ldots c_n$ such that the sum of the squares of the deviations between $f(x_1)$ and $f^*$ is minimized.

The matrix formulation of the least squares method means that the following matrices are formed $$A=\begin{pmatrix} \cdot & & \cdot \\ \cdot & & \cdot \\ \cdot & & \cdot \\ \phi_1 & \phi_2 \ldots & \phi_n \\ \cdot & & \cdot \\ \cdot & & \cdot \\ \cdot & & \cdot \end{pmatrix}$$

with A=m·n where m=the number of measuring points=the number of lines in A and n=the number of basic functions $\phi_1, \ldots \phi_n$=the number of columns in A, $$c=\begin{pmatrix} c_1 \\ \cdot \\ \cdot \\ \cdot \\ \cdot \\ \cdot \\ c_n \end{pmatrix}$$

$$f=\begin{pmatrix} f_1 \\ f_2 \\ \cdot \\ \cdot \\ \cdot \\ \cdot \\ \cdot \\ \cdot \\ \cdot \\ f_m \end{pmatrix}$$

where $f_1, f_2, \ldots f_m$ are the measured data obtained.

According to the least squares method, the following relationship applies between the matrices for determining $c_1, \ldots c_n$:

$$A^T A \cdot c = A^T \cdot f \tag{3}$$

where $A^T$ is the transposed matrix A. Without going further into the details of the method, the determination according to the prior art entails a time-consuming arrangement of the quadratic matrix $A^T A$ for each flatness curve.

From the point of view of feedback control, it is now desired to set up the functions $\phi_i$ which correspond to the mechanical actuator actions, for example the bending action which gives a flatness response of the form $\phi_B$ and then determine the corresponding $c_B$ together with the corresponding functions for the other control members.

From the computational point of view, this entails a considerable problem. With a calculation time of 0.15 ms per multiplication, the calculation time of the matrix for 3 control members and 50 measured values for each flatness curve will be about 160 ms, which means that it is not possible to evaluate each flatness curve.

There are different ways of solving this problem, which, however, entail reduced accuracy in the flatness control. One method of solution is disclosed by EP 0 063 606, "System for controlling the shape of a strip". Here, orthogonal functions are used where the quadratic matrix only contains a diagonal line with terms different from zero. The demands imposed by the control for functions which correspond to the actions are then abandoned and other functions are relied upon, and some interlinking is performed afterwards. The greatest disadvantage of this method is the restriction to polynomials and sine functions and that a higher order has to be used to approximate the flatness error in a satisfactory way.

Another method is disclosed in GB 2 017 974 A "Automatic control of rolling". In this case, the solution principle is to restrict the evaluation to a straight line and a parabola, that is, as "a curve of the form $ax^2+c$", as is clear, for example, from page 3, column 1, line 7 thereof.

SUMMARY OF THE INVENTION

The invention relates to an optimization of the control actions via control members for the work rolls during flatness control of strip and comprises a method for evaluation of the control actions as well as an evaluation device which constitutes an integral part of the control equipment.

The starting point of a method according to the invention is the relationship $$A^T A \cdot c = A^T \cdot f \tag{3}$$

according to the above. The invention and the evaluation mean that the vector c is solved explicitly as $$c=(A^T A)^{-1} \cdot A^T \cdot f = B \cdot f \tag{4}$$

In the general case, all the functions $\phi_1, \phi_2 \ldots \phi_n$ in the A-matrix are selected or determined in advance. Thereby the transposed matrix $A^T$, the matrix $A^T A$, the inverted matrix $(A^T A)^{-1}$ and the matrix $B=(A^T A)^{-1} \cdot A^T$ can be determined. With access to measured data $f_1, f_2 \ldots f_m$, it is therefore a relatively simple matrix multiplication to evaluate $c_i$, that is, obtain current values of $c_1, c_2 \ldots c_n$.

The above-mentioned functions $\phi_S$, $\phi_B$ and $\phi_F$, corresponding to the actions skewing, bending and shifting, for the case involving three control members, can be determined in advance. These functions are not changed during rolling of a strip with a given width. Since the matrix A only contains these $\phi$-functions, the A-matrix, and hence according to the above the B-matrix, can be determined before the rolling starts. The B-matrix consists of a matrix with the same number of vectors as the control members.

During the rolling operation, an evaluation of the $c_i$-values for each $\phi_i$-function now takes place with the aid of the least squares method. The $c_i$-values are obtained by multiplication of $B=(A^T A)^{-1} \cdot A^T$. The $A^T$-matrix with the f-matrix, that is, with the values of the flatness errors obtained, and represent the input signals to the control devices and regulators of the control members, which input signals are converted into roll gaps. In this way, the $c_i$-values constitute a measure of the control error for the respective control member. This method means that the need of computer capacity is considerably reduced while at the same time the control errors can easily be calculated between each flatness curve obtained.

In addition to a comparator for comparison between the desired and the measured flatness and a control device and a regulator for the executing devices included in the form of control members, as in a conventional control, a plant for flatness control of strip comprises an evaluation device according to the invention. The evaluation device suitably consists of a computer which is preprogrammed with the equations described and which has the difference between actual and desired flatness as well as the known stress distributions as input signals. The output signals of the evaluation device consist of the control errors or the input signals to the different control devices and regulators.

BRIEF DESCRIPTION OF THE DRAWING

The sole FIGURE illustrates a preferred embodiment of the best mode of structure for carrying out the invention.

DESCRIPTION OF THE PREFERRED EMBODIMENTS

An embodiment of a device according to the invention constitutes an integral part of flatness control of strip as is clear from the accompanying figure. The control members for the flatness control in the example shown are skewing, bending and shifting. The end product of the rolling process is a rolled strip whose flatness is determined in a suitable way, for example by means of a STRESSOMETER 1. The flatness obtained is compared in a summator or comparator 2 with the desired flatness reference. The flatness errors obtained, $f_1, f_2 \ldots f_n$, are supplied to an evaluation device 3 to determine, in accordance with the equations described, the control errors $c_S$, $c_B$ and $c_F$, that is, the control actions for skewing, bending, and shifting.

Before the rolling starts, the evaluation device has been supplied with information about the stress distribution for skewing, that is, $\phi_S$, with a normalized characteristic as a function of the width b of the strip according to function generator 4 of the sole FIGURE of the invention and the corresponding stress distributions for bending $\phi_B$ and shifting $\phi_F$ according to function generators 5 and 6. The stress distributions for the rolling mill in question, that is, for the control members included, can for different band widths b, materials, etc., either be calculated or obtained by direct to measurement, as described above.

This means that the matrix A in question will have the form $$A = \begin{pmatrix} \cdot & \cdot & \cdot \\ \cdot & \cdot & \cdot \\ \cdot & \cdot & \cdot \\ \phi_S & \phi_B & \phi_F \\ \cdot & \cdot & \cdot \\ \cdot & \cdot & \cdot \\ \cdot & \cdot & \cdot \end{pmatrix}$$

and that the matrix $B=(A^TA)^{-1}\cdot A^T$ can be determined before the rolling starts. According to the summary of the invention, the B-matrix consists of as many vectors as there are control devices, that is, in this case of three vectors. If these are identified as $\psi_S$-vector for skewing, $\psi_B$-vector for bending and $\psi_F$-vector for shifting, the B-matrix for an embodiment according to the accompanying figure will be $$B = \begin{pmatrix} \psi_{S1} & \psi_{S2} & \ldots & \psi_{Sm} \\ \psi_{B1} & \psi_{B2} & \ldots & \psi_{Bm} \\ \psi_{F1} & \psi_{F2} & \ldots & \psi_{Fm} \end{pmatrix}$$

whereby

-continued $$c_i = B \cdot f = \begin{pmatrix} \psi_{S1} & \psi_{S2} & \ldots & \psi_{Sm} \\ \psi_{B1} & \psi_{B2} & \ldots & \psi_{Bm} \\ \psi_{F1} & \psi_{F2} & \ldots & \psi_{Fm} \end{pmatrix} \begin{pmatrix} f_1 \\ f_2 \\ \cdot \\ \cdot \\ \cdot \\ \cdot \\ \cdot \\ f_m \end{pmatrix}$$

The control error or the input signal $c_S$ for skewing is now determined in the usual manner as $$c_S = \psi_{S1} \cdot f_1 + \psi_{S2} \cdot f_2 + \ldots + \psi_{Sm} \cdot f_m$$

The corresponding input signal for bending will be $$c_B = \psi_{B1} \cdot f_1 + \psi_{B2} \cdot f_2 + \ldots + \psi_{Bm} \cdot f_m$$

and the input signal for shifting will be $$c_F = \psi_{F1} \cdot f_1 + \psi_{F2} \cdot f_2 + \ldots + \psi_{Fm} \cdot f_m$$

The control error $c_S$ is supplied to a control device and regulator 7 for skewing for setting the rolls via the screw control actuator 8. The control error $c_B$ is supplied to a control device and regulator 9 for bending of the rolls via the bending control actuator 10. The control error $c_F$ is supplied to a control device and regulator 11 for shifting the rolls via the shifting member 12. The control members then influence the rolling process 13 such that the desired flatness curve is obtained and maintained.

The setting times for the skewing, bending and shifting settings are different, depending on the control members used. A typical setting time for screw setting is, for example, 50 ms, and the corresponding times for skewing and shifting are about 100 ms. This means that no evaluation of the c-values for the slow members is needed for each new measured value. Because of the provision of the B-matrix according to the invention, therefore, the need of computer capacity can be further reduced since only the matrix multiplication for the current $\psi$-vector with the f-vector can be produced separately and where necessary.

I claim:

1. A method for generating input signals for operating control members to control the flatness of strip in a rolling mill in response to input signals $c=c_1, c_2 \ldots c_n$, wherein the stress distributions $\phi_1, \phi_2 \ldots \phi_m$, which arise across the strip when the respective control members are actuated, are known and wherein data $f(x_i)=f_1, f_2 \ldots f_m$ which indicate flatness errors across the strip are known, and further assuming the following function:

$f^*_n = c_1\phi_1 + c_2\phi_2 + \ldots c_n\phi_n$, said method comprising the steps of:

determining the input signals such that the squares of the deviations between $f(x_i)$ and $f^*$ are minimized;

forming the following matrices:

$$A=\begin{Bmatrix} \cdot & & \cdot \\ \cdot & & \cdot \\ \cdot & & \cdot \\ \phi_1, & \phi_2 \ldots & \phi_n \\ \cdot & & \cdot \\ \cdot & & \cdot \\ \cdot & & \cdot \end{Bmatrix}$$

with A=m·n, where m=the number of measuring points equals the number of lines in A;

n=the number of base functions $\phi_1 \ldots \phi_n$=the number of columns in A;

$$C=\begin{Bmatrix} c_1 \\ \cdot \\ \cdot \\ \cdot \\ \cdot \\ \cdot \\ \cdot \\ c_n \end{Bmatrix} \text{ and } f=\begin{Bmatrix} f_1 \\ f_2 \\ \cdot \\ \cdot \\ \cdot \\ \cdot \\ \cdot \\ \cdot \\ f_m \end{Bmatrix}$$

further generating the input signals according to the following formula:

$$c=(A^TA)^{-1}\cdot A^T\cdot f=B\cdot f$$

where $A^T$ is the transposed A-matrix; and determining the matrix B as follows before commencing rolling the strip:

$$B=(A^TA)^{-1}\cdot A^T.$$

2. A method according to claim 1, wherein the steps of determining and generating the input signals include the step of determining and generating only those input signals which, depending on the setting time of the current control member, need to be updated for each measurement.

3. A method for generating input signals for operating control members to control the flatness of strip in a rolling mill, wherein a skewing stress distribution $\phi_S$, bending stress distribution $\phi_B$ and shifting stress distribution $\phi_F$, which arise across the strip when the respective control members are actuated, are known and wherein data $f(x_1)=f_1, f_2 \ldots f_m$, which indicate flatness errors across the strip, are known, and further assuming the following function:

$$f^*_1=c_S\cdot\phi_S+c_B\cdot\phi_B+c_F\cdot\phi_F$$

where $c_S$, $c_B$ and $c_F$ are the input signals of the respective control devices;

determining the input signals signals so that the square of the deviations between $f(x_i)$ and f* are minimized and using the following matrices:

$$A=\begin{Bmatrix} \cdot & \cdot & \cdot \\ \cdot & \cdot & \cdot \\ \cdot & \cdot & \cdot \\ \phi_S & \phi_B & \phi_F \\ \cdot & \cdot & \cdot \\ \cdot & \cdot & \cdot \\ \cdot & \cdot & \cdot \end{Bmatrix}$$

$$c=\begin{Bmatrix} c_S \\ c_B \\ c_F \end{Bmatrix}$$

and:

$$f=\begin{Bmatrix} f_1 \\ f_2 \\ \cdot \\ \cdot \\ \cdot \\ \cdot \\ \cdot \\ \cdot \\ \cdot \\ f_m \end{Bmatrix}$$

and;

$B=(A^TA)^{-1}\cdot A^T$ and wherein expressing the B-matrix as a $\psi_s$-vector for skewing, a $\psi_B$-vector for bending, and a $\psi_F$-vector for shifting according to the following matrix:

$$B=\begin{Bmatrix} \psi_{S1} & \psi_{S2} & \ldots & \psi_{Sm} \\ \psi_{B1} & \psi_{B2} & \ldots & \psi_{Bm} \\ \psi_{F1} & \psi_{F2} & \ldots & \psi_{Fm} \end{Bmatrix}$$

determining the input signals as:

$$c=B\cdot f\equiv\begin{Bmatrix} \psi_{S1} & \psi_{S2} & \psi_{Sm} \\ \psi_{B1} & \psi_{B2} & \psi_{Bm} \\ \psi_{F1} & \psi_{F2} & \psi_{Fm} \end{Bmatrix}\begin{Bmatrix} f_1 \\ f_2 \\ \cdot \\ \cdot \\ \cdot \\ \cdot \\ \cdot \\ \cdot \\ \cdot \\ f_m \end{Bmatrix}$$

whereby the input signal $c_S$ for skewing is determined and generated as:

$$c_S=\psi_{S1}\cdot f_1+\psi_{S2}\cdot f_2+\ldots+\psi S_m\cdot f_m, \text{ and:}$$

determining and generating the input signal for bending as follows:

$$c_B=\psi_{B1}\cdot f_1+\psi_{B2}\cdot f_2+\ldots+\psi_{Bm}\cdot f_m, \text{ and}$$

determining and generating the input signal for shifting as follows:

$$c_F=\psi_{F1}\cdot f_1+\psi F_2+\ldots+\psi_{Fm}\cdot f_m.$$

4. A device for generating input signals for operating control members to control the flatness of strip in a rolling mill, wherein the stress distributions $\phi_1, \phi_2 \ldots \phi_n$, which arise across the strip when the respective control members are actuated, are known and wherein data $f(x_1)=f_1, f_2 \ldots f_m$, which indicate flatness errors across the strip, are known, and comprising:

means for forming the following matrices:

$$A=\begin{Bmatrix} \cdot & & \cdot \\ \cdot & & \cdot \\ \cdot & & \cdot \\ \phi_1, & \phi_2 \ldots & \phi_n \\ \cdot & & \cdot \\ \cdot & & \cdot \\ \cdot & & \cdot \end{Bmatrix}$$

with A=m·n where m=the number of measuring points equals the number of lines in A and n=the number of base functions $\phi_1, \ldots \phi_n$=the number of columns in A;

and $$f=\begin{Bmatrix} f_1 \\ f_2 \\ \cdot \\ \cdot \\ \cdot \\ \cdot \\ \cdot \\ \cdot \\ f_m \end{Bmatrix}$$

and means for further determining and generating the input signals according to the following formula:

$$c=(A^TA)^{-1}\cdot A^T\cdot f=B\cdot f$$

where $A^T$ is the transposed A-matrix and that the matrix; and determining B as follows before commencing rolling the strip:

$$B=(A^TA)^{-1}\cdot A^T.$$

5. A device according to claim 4, further comprising control members for skewing with a known stress distribution $\phi_S$, members for bending with a known stress distribution $\phi_B$, members for shifting with a known stress distribution $\phi_F$ and wherein the stress distribution members and flatness errors are input signals and further comprising means for forming the following matrices:

$$A=\begin{Bmatrix} \cdot & & \cdot \\ \cdot & & \cdot \\ \cdot & & \cdot \\ \phi_S & \phi_B & \phi_F \\ \cdot & & \cdot \\ \cdot & & \cdot \\ \cdot & & \cdot \end{Bmatrix}$$

$$f=\begin{Bmatrix} f_1 \\ f_2 \\ \cdot \\ \cdot \\ \cdot \\ \cdot \\ \cdot \\ f_m \end{Bmatrix}$$

and $$B=(A^TA)^{-1}\cdot A^T;\text{ and}$$

means for forming the input signals:

$$c=\begin{Bmatrix} c_S \\ c_B \\ c_F \end{Bmatrix}=(A^TA)^{-1}\cdot A^T\cdot f=B\cdot f.$$

* * * * *